US009005372B2

(12) United States Patent
Lölsberg

(10) Patent No.: US 9,005,372 B2
(45) Date of Patent: Apr. 14, 2015

(54) CLEANING DEVICE FOR A PORTIONING UTENSIL

(76) Inventor: Bernd Lölsberg, Kürnach (DE)

( * ) Notice: Subject to any disclaimer, the term of this patent is extended or adjusted under 35 U.S.C. 154(b) by 993 days.

(21) Appl. No.: 12/980,438

(22) Filed: Dec. 29, 2010

(65) Prior Publication Data

US 2012/0132237 A1 May 31, 2012

(30) Foreign Application Priority Data

Nov. 29, 2010 (DE) ..... 20 2010 015 899 U

(51) Int. Cl.
*A47L 15/00* (2006.01)
*A47L 17/00* (2006.01)

(52) U.S. Cl.
CPC ..... *A47L 17/00* (2013.01)

(58) Field of Classification Search
CPC ..... A47L 17/00
See application file for complete search history.

(56) References Cited

U.S. PATENT DOCUMENTS 2,665,440 A * 1/1954 Starcevich ..... 15/101

FOREIGN PATENT DOCUMENTS

EP 0819403 A2 * 1/1998 ..... A47L 15/00
EP 0838158 A1 * 4/1998 ..... A23G 9/28

OTHER PUBLICATIONS

English machine translation of EP0838158A1.*

* cited by examiner

*Primary Examiner* — Michael Barr
*Assistant Examiner* — Jason Riggleman
(74) *Attorney, Agent, or Firm* — Fredkrikson & Byron, P.A.

(57) ABSTRACT

The embodiments of the present invention relate to a cleaning device for a portioning utensil for portioning ice cream or the like, which is intended to be utilized in receptacles, respectively in rinsing tanks. Here, the cleaning device includes a carrier module which can be mounted in the receptacle and a cleaning module which is releasably coupled to the carrier module. Moreover, the cleaning device includes an actuating device being disposed in the cleaning module, and the cleaning device includes an actuating valve which can be controlled via the actuating device and which is closed in the initial position. The embodiments of the invention are characterized by a closing valve which is designed in the form of a separate valve or which at the same time acts as an actuating valve. The closing valve is formed and arranged in the carrier module, thereby making it possible that the closing valve is closed when the cleaning module is removed from the carrier module.

7 Claims, 9 Drawing Sheets

CLEANING DEVICE FOR A PORTIONING UTENSIL

RELATED APPLICATIONS

This application claims priority to German Utility Model Application No. 20 2010 015 899.0 filed Nov. 29, 2010, the contents of which are hereby incorporated by reference.

The embodiments of the present invention relates to a cleaning device for cleaning a portioning utensil which is utilized for portioning ice cream or the like. The cleaning device can be inserted into a receptacle, wherein cleaning fluid supplied via nozzles of the cleaning device enables cleaning of the portioning utensil.

From the state of the art, a large variety of different types of cleaning devices for the catering industry are known, which are intended to be utilized in rinsing tanks or receptacles. In this regard, cleaning devices for cleaning portioning utensils are known, which can be inserted into an opening in a receptacle. The cleaning fluid is accordingly supplied to the cleaning device from the outside of the receptacle. Typically, the known cleaning devices feature an actuating mechanism which controls the flow of the cleaning fluid. In this regard, the actuating mechanism as a general rule is designed in such a manner that the flow is stopped in the absence of actuation of the actuating mechanism and the flow is released upon actuation of the actuating mechanism. Moreover, the cleaning devices conventionally feature nozzles, by means of which the cleaning fluid can be dispensed and sprayed onto the portioning utensil. By utilizing the cleaning device in a receptacle or a rinsing tank, it is ensured that the sprayed cleaning fluid can be captured and discharged.

Besides, it is necessary to regularly clean the cleaning devices themselves. For this purpose, from the state of the art systems are known in which the cleaning device can be modularly disassembled. Here, rinsing rods having nozzles disposed thereon are attached so as to be manually removable. In any case, at least a base to which the cleaning fluid is supplied from the outside of the receptacle remains in the receptacle.

Even though the cleaning device itself, in particular the rinsing rods having the nozzles, can be advantageously cleaned using the suggested solutions, there exists the fundamental problem that the base remaining in the receptacle is open towards the interior of the receptacle when the cleaning device is disassembled into its modular components. Thus, there is a risk that waste water contained in the receptacle enters the supply line through the base. This circumstance absolutely needs to be prevented in order to in turn preclude contamination of the cleaning fluid.

Moreover, there exists the problem that in the known embodiments, wherein the rinsing rods can be removed from the base together with the actuating mechanism, it is mandatory to firstly close the supply line prior to removal. Otherwise, removal of the cleaning device from the base would cause the cleaning fluid to uncontrollably flow out of the base being mounted in the receptacle.

Hence, it is an object of the present invention to present a modular cleaning device, wherein removal of the part containing the nozzles is enabled for the purpose of cleaning said part, without the need to block the supply line.

A generic cleaning device is intended for cleaning portioning utensils or the like. Here, the portioning utensil in turn serves for portioning ice cream or the like. These utensils may be in particular spoons or spatulas.

For utilization the cleaning device can be inserted into a receptacle, wherein for this purpose a carrier module of the cleaning device is mounted in an opening in the receptacle.

On the outside of the receptacle, a supply line needs to be correspondingly coupled to the carrier module, by means of which the carrier module can be supplied with the cleaning fluid. When the cleaning device itself is cleaned, the carrier module remains in the receptacle.

In addition, the cleaning device comprises a cleaning module which is releaseably coupled to the carrier module. In this regard, the user of the cleaning device is enabled to manually detach the cleaning module from the carrier module, i.e. to remove it from the receptacle, for the purpose of cleaning the cleaning module. It is obvious that the cleaning module can be attached again at the carrier module by the user. Consequently, the generic cleaning device has a modular configuration, wherein for the purpose of cleaning, the carrier module remains at the receptacle and the cleaning module can be separated from the carrier module. In this way, the cleaning module itself can be cleaned in a simple manner.

The cleaning fluid can then be dispensed via at least one nozzle of the cleaning module. Thus, a volume flow takes place from the supply line through the carrier module and through the cleaning module until being dispensed through the nozzles. Moreover, the cleaning module comprises an actuating device, by means of which the flow though the cleaning device can be controlled. Here, an actuating valve is disposed in the carrier module or the cleaning module. In the initial position, the actuating valve is closed. Hence, it is ensured that the cleaning fluid does not uncontrollably flow in the absence of actuation. Upon actuation of the actuating device, the actuating valve allows the cleaning fluid to flow. Here, the type of the actuating valve and the type of the actuating device is firstly irrelevant. At least it should be ensured that the actuating valve is closed in the starting situation, respectively in the initial position, and is released when the actuating device is actuated. Thus, it is rendered possible that the cleaning fluid can be sprayed on the corresponding portioning utensil upon actuation.

According to the embodiments of the invention, in a first alternative, a closing valve is disposed in the carrier module. Here, the closing valve needs to be configured in such a manner that at least upon removal of the cleaning module from the carrier module, the closing valve is closed and a flow is prevented.

This newly developed embodiment, wherein the closing valve is disposed in the carrier module, for the first time makes it possible to remove the cleaning module from the carrier module without the need for disconnecting the supply line. Moreover, it is thus ensured that waste water is incapable of uncontrollably entering the supply line. Hence, it is ensured in a particularly simple and at the same time particularly advantageous manner that the cleaning module can be cleaned without any additional efforts or a risk of contamination of the supply line.

In this respect, it is particularly advantageous if the closing valve has a first movable closing element, which is pushed into the direction of the cleaning module onto a first valve seat in the carrier module with the aid of a first compression spring. Thus, the carrier module features a valve seat conventionally known for a valve, wherein the functional counterpart is constituted by the first closing element. The utilization of a compression spring for securing the position of the closing element here can be easily realized as regards implementation and is at the same time reliable in terms of the functional solution.

Moreover, it is particularly advantageous if mounting the cleaning module on the carrier module causes the first closing element to be depressed and causes the closing valve to be opened.

Basically, it is firstly necessary that removal of the cleaning module from the carrier module causes closure of the closing valve. Thus, it is obvious that it is particularly advantageous if mounting the cleaning module on the carrier module correspondingly causes the closing element to be opened. Hence, the actuation of the closing element is realized purely by mounting, respectively demounting, the cleaning module.

For implementation, different solutions are available, wherein a suitable geometry of the connection of the cleaning module at the carrier module having the first closing element enables functionality. In this respect, it is advantageous if an abutment surface at the cleaning module can be brought into abutment against the first closing element upon mounting of the cleaning module on the carrier module, wherein the mounting movement makes it possible to depress the closing element against the first compression spring. This solution is particularly simple if the first closing element in the demounted position of the cleaning module protrudes beyond the carrier module and if a flush depression is required for opening the closing valve.

As an alternative to the utilization of a compression spring and the associated opening movement of the first closing valve, it is equally possible to employ a torsion spring and to provide a turning movement of the closing valve. It would be possible that for instance by fastening the cleaning module at the carrier module using a bayonet catch, the turning mounting movement thereof simultaneously causes turning of the first closing element and thus opening of the closing valve.

With respect to the actuating device it is advantageous if it features a compression body which is firmly coupled to a second closing element via a compression rod. Here, the compression rod together with the compression body and the closing element is directly or indirectly pushed into the direction of the compression body with the aid of a second compression spring. Thus, the compression spring secures the arrangement of the actuating device in the final position, respectively the initial position. In this case, the second closing element abuts against a second valve seat in the cleaning module. It is obvious that in the initial position, the actuating valve is thus closed by the second closing element. According to the functionality of the actuating device, a pressure exerted on the compression body with transmission via the compression rod causes displacement of the second closing element and thus opening of the actuating valve.

In a second inventive alternative, the actuating valve is disposed in the carrier module. Hence, it is obvious that the actuating module remains in the carrier module upon removal of the cleaning module. Thus, it is possible that the actuating module simultaneously serves as a closing valve. Here, the actuating valve is closed upon removal of the cleaning module from the carrier module and a flow is thus prevented.

According to the embodiments of the invention, in the second alternative, in contrast to the first alternative, the closing valve is joined with the actuating valve to form a single valve. According to the embodiments of the invention, it is here thus necessary that the actuating valve is disposed in the carrier module. Here, just like in the first alternative, it needs to be ensured that the actuating valve is closed during removal of the cleaning module from the carrier module. In this way, the same advantageous effect is realized as that realized in the first exemplary alternative with the closing valve.

Here, it is particularly advantageous if the actuating valve features a movable closing element, which is pushed into the direction of the cleaning module onto a valve seat in the carrier module with the aid of a first compression spring. In this regard, the actuating valve of the second alternative corresponds to the closing valve of the first alternative.

In this context, it is particularly advantageous if the actuating device features a compression body which is mounted in the cleaning module via a compression rod. According to the arrangement of the actuating valve in the carrier module and the actuating device in the cleaning module, it is obvious that the actuating device does not feature a firm connection to the actuating valve. It is obvious that the compression rod is required to act on the closing element for actuating the actuating valve. In the absence of actuation, however, the actuating valve is closed. The initial position for instance may be defined by the free abutment of the compression rod against the closing element. In this initial position, it is ensured that an abutment of the closing element against the valve seat, contrary to the first alternative, here is realized in the carrier module. Thus, the actuating valve is also closed and a flow of cleaning fluid is prevented.

It is particularly advantageous if, just like in the first alternative, the compression rod is directly or indirectly pushed into the direction of the compression body with the aid of a second compression spring and thus defines an initial position. Thus, a play recommended for permitting a tolerance between the compression rod and the closing element does not result in a "loose" compression rod, but rather in a defined arrangement in the upper position.

Alternatively, it is advantageous if a second counteracting compression spring is employed. In this case, the compression rod together with the compression body is pushed into the direction of the carrier module. This embodiment further simplifies the structure of the cleaning module and thus lowers the production costs thereof. In this case, the second compression spring, in the case of the cleaning module being mounted on the carrier module, causes the compression rod to abut against the closing element. Thus, a "loosely" appearing compression rod is equally avoided. The initial position, in contrast to the foregoing embodiment, constitutes a lower position being displaced by the play.

It is apparent that upon removal of the cleaning module from the carrier module, with the actuating valve remaining in the carrier module, the closing element remains at the valve seat as a result of the inventive embodiment and thus prevents the cleaning fluid from uncontrollably flowing upon removal of the cleaning module. At the same time, opening of the actuating valve is permitted upon actuation of the actuating device if the cleaning module is mounted on the carrier module.

In this regard, it is particularly advantageous if at least during actuation by depressing the compression body, the compression rod comes into abutment against the closing element and the actuating valve is opened upon further depression.

In this context, it is irrelevant if the compression rod is in contact with the closing element immediately, already in the absence of actuation, upon mounting of the cleaning module on the carrier module or if a distance is advantageously provided between the compression rod and the closing element, so that the elements are brought into abutment against each other only upon an initial actuation. In any case, opening of the actuating valve by means of the actuating device is enabled by depression of the compression body.

Here, it is obvious that a valve is not present in the cleaning module upon removal of the cleaning module from the carrier module, so that in this case a free flow through the cleaning module up to the nozzles is enabled.

When considering the costs associated with the two alternatives, the second alternative proves to be advantageous, whereas the first alternative provides the advantage that waste water contained in the receptacle is prevented from uncontrollably flowing into the cleaning device upon removal of the cleaning module due to the actuating valve.

In both alternatives it is advantageous if the cleaning module is coupled to the carrier module via a screw thread. Thus, a particularly simple and at the same time functional connection type is produced between the cleaning module and the carrier module.

Moreover, it is in any case advantageous if a non-return valve is provided in the carrier module. Here, the non-return valve acts in such a manner that, when an increased pressure prevails in the supplied cleaning fluid, the non-return valve is opened. Thus, it is obvious that the non-return valve is closed when the pressure decreases in the supply line, and the flow in the carrier module is thus prevented irrespective of the position of the actuating device or the closing valve.

The simultaneous utilization of the first compression spring as a functional component of the non-return valve is particularly advantageous, which pushes the first closing element, respectively the second closing element, against the corresponding valve seat. Hence, for realizing the non-return valve merely one further third closing element is required, which stops the flow by abutting against a third valve seat in the carrier module. Thus, the first compression spring simultaneously causes the closing valve and the non-return valve to close if a least the cleaning module is removed from the carrier module and if no pressure prevails in the supply line. Hence, in this case, the expenditure in terms of production and assembly can be kept at a low level.

For cleaning the corresponding portioning utensil it is advantageous if a plurality of nozzles are arranged so as to surround the compression rod. In this way, spraying the portioning utensil from different sides is advantageously enabled.

Moreover, it is particularly advantageous if the cleaning module features a lower nozzle body having the lower nozzles and at least one upper nozzle body having at least one upper nozzle. Here, the upper nozzle body is connected to the lower nozzle body via a connecting pipe. This embodiment makes the cleaning of the corresponding portioning utensil particularly easy, since the portioning utensil can be sprayed from two opposing sides.

To prevent excessive spraying of the cleaning fluid during utilization of the cleaning device, it is advantageous if the flow to the upper nozzle can be controlled by means of a variably settable flow restrictor being disposed in the upper nozzle body. Hence, it is possible to set the sufficient amount for cleaning the corresponding portioning utensil.

In addition, it is advantageous if a removable dirt trap is disposed at the cleaning device. Here, the dirt trap should be disposed so as to surround the lower nozzles and should be designed in the form of a screen or in the type of a gutter having drainage holes. Thus, larger dirt particles dripping down from the portioning utensil can be captured, so that these particles are prevented from reaching a drainage screen of the receptacle. The removable embodiment here makes it possible to remove the dirt trap from the cleaning device and to empty it into a waste container, in order to be subsequently able to mount it again. The dirt trap can be configured in a particularly simple manner if it is disposed so as to substantially surround the lower nozzle body in the form of a rotating body, wherein the connecting pipe extends to the upper nozzle body on the outside of the dirt trap.

The following figures exemplarily illustrate the embodiments of the invention.

Figure 1:
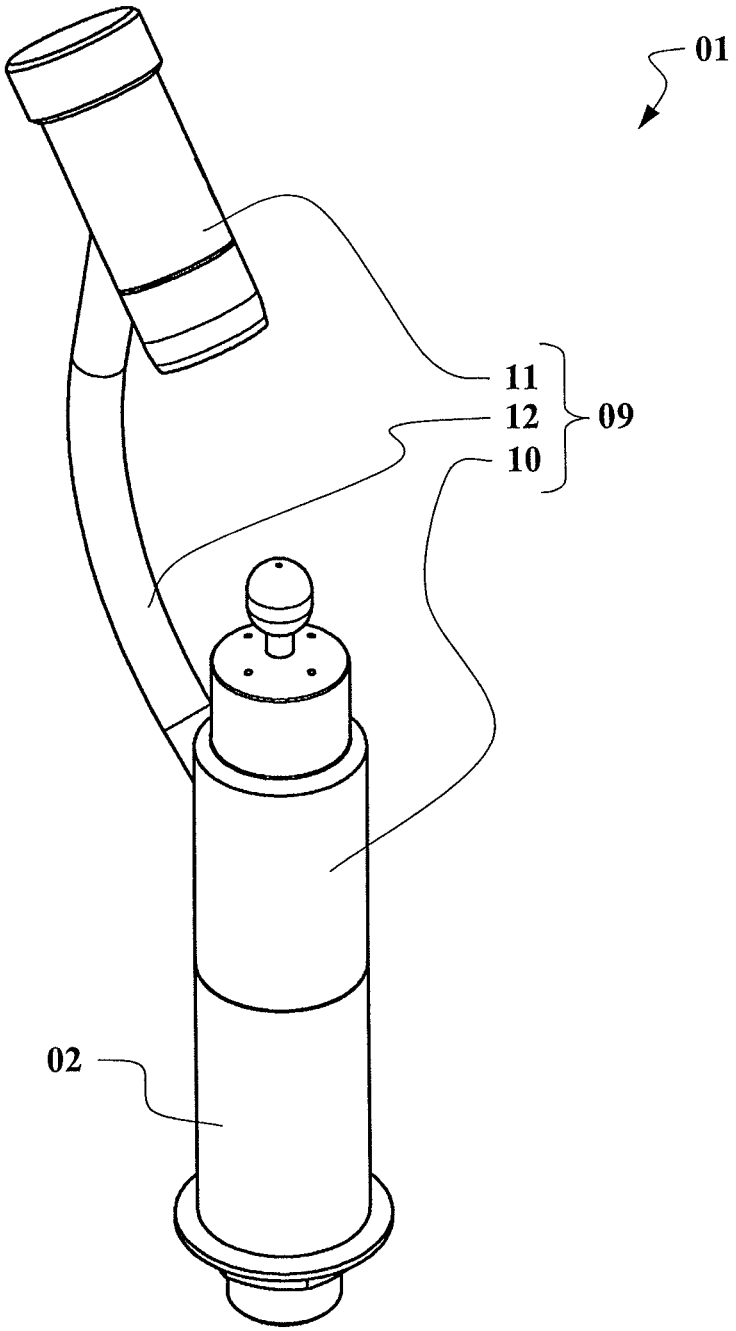
FIG. 1 shows a perspective view of a first embodiment of a cleaning device to according to the invention.

FIG. 1 shows a perspective view of a first embodiment of a cleaning device 01 according to the invention. Here, the cleaning device 01 includes a carrier module 02 and a cleaning module 09 connected thereto by a connecting pipe 12. The cleaning module 09 includes a lower nozzle body 10, an upper nozzle body 11 and the joining connecting pipe 12.

Figure 2:
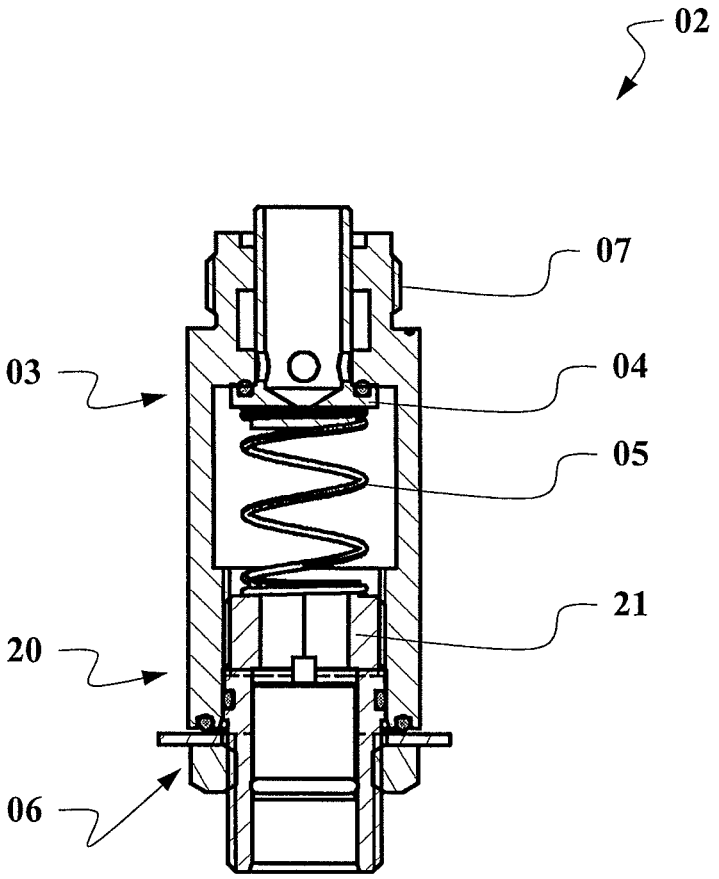
FIG. 2 shows the carrier module of the cleaning device according to FIG. 1 in cross-sectional view.

FIG. 2 schematically illustrates the carrier module 02 of the embodiment according to FIG. 1 in a cross-sectional view. The arrangement of a closing valve 03 is discernible, which is constituted by a first closing element 04 being in abutment against a first valve seat. The actuating force here is produced by a first compression spring 05. Also, in this embodiment, a non-return valve 20 is formed by a third closing element 21 having a third valve seat disposed in the carrier module 02. Here, the first compression spring at the same time acts on the third closing element 21. It is obvious that, when no pressure prevails in the supply line, the non-return valve 20 is closed. By the same token, in the absence of actuation of the first closing element 04, the closing valve 03 is closed. It is obvious that the non-return valve 20 is opened when an increased pressure prevails in the supply line acting against the pressure of the first compression spring 05. By contrast, the closing valve 03 is opened upon mechanical actuation of the first closing element 04. For this purpose, the closing element 04 is correspondingly required to be depressed. Moreover, FIG. 2 illustrates the mounting base 06 at the carrier module, by means of which the carrier module can be mounted in the receptacle opening. The connection to the cleaning module in the exemplary case is realized by a screw thread 07 at the upper end of the carrier module 02.

Figure 3:
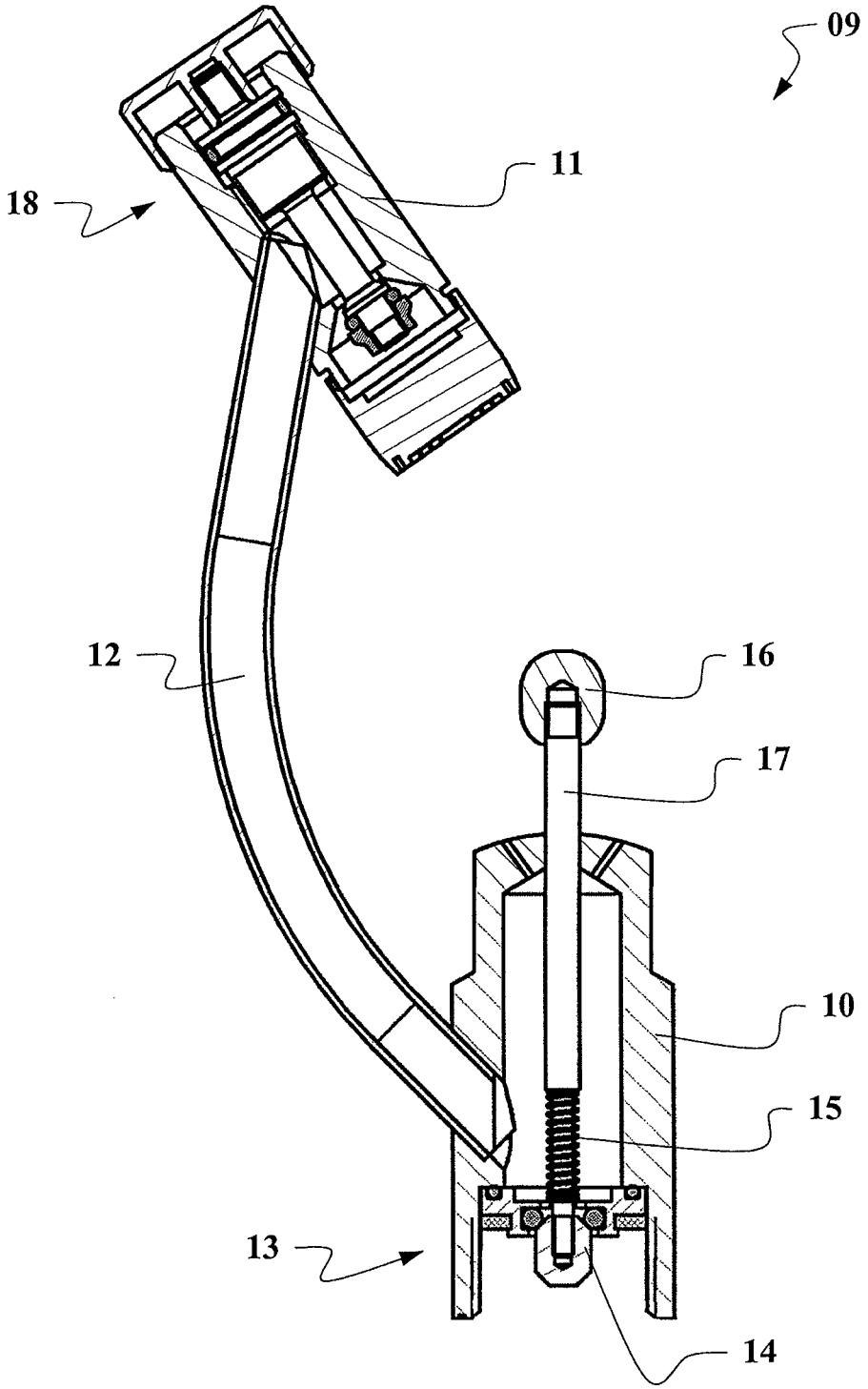
FIG. 3 shows the cleaning module of the cleaning device of FIG. 1 in cross-sectional view.

FIG. 3 schematically illustrates the cleaning module 09 of the embodiment according to FIG. 1 in a cross-sectional view. The lower nozzle body 10, the upper nozzle body 11 and the joining connecting pipe 12 are illustrated again. It is apparent how the cleaning fluid is guided from the lower nozzle body 10 through the connecting pipe 12 to the upper nozzle body. In the lower nozzle body 10, the actuating device is disposed. The actuating device comprises a compression body 16 and a joining compression rod 17. A second closing element 14, which forms a part of the actuating valve 13, is firmly connected to the compression rod 17. The illustrated initial position, in which the actuating valve 13 is closed, is readily discernible. The initial position is realized by the second compression spring 15, which pushes the compression rod 17 into the direction of the compression body. It is obvious how the actuating valve 13 can be opened when the compression body 16 is depressed.

According to the generic type nozzles are provided in the lower nozzle body, wherein it is irrelevant if a further nozzle, respectively further nozzles, are also provided in the compression body. Nozzles are likewise provided at least in the upper nozzle body 11, wherein the flow from the connecting pipe 12 to the nozzles of the upper nozzle body 11 can be restricted by a flow restrictor 18.

Figure 4:
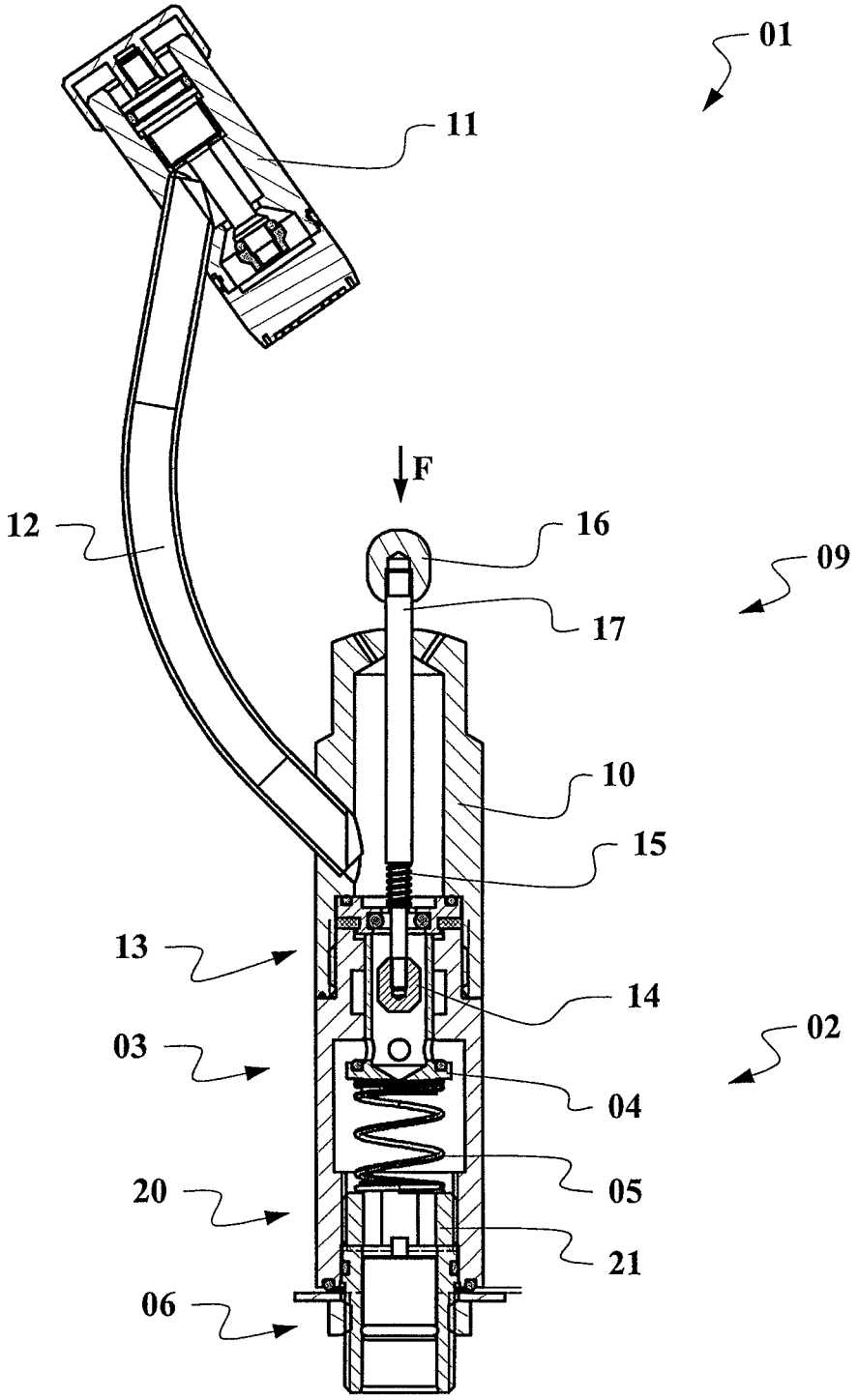
FIG. 4 shows the cleaning device of FIG. 1 in a cross-sectional view with the actuating device being in the actuated position.

FIG. 4 shows the cleaning device 01 of FIG. 1 in a cross-sectional view upon actuation of the actuating device. The carrier module 02 and the cleaning module 09 are discernible again. In this regard, reference is made to the previously provided figure descriptions. It is in any case apparent that the closing valve 03 is open. This is made possible by the aspect that the mounted cleaning module 09 as a result of its geometry depresses the first closing element 04 during screwing. Thus, it is apparent that in this exemplary embodiment the closing valve 03 is open when the cleaning device 03 is assembled.

Besides, it is apparent that the actuating valve 13 is opened upon actuation of the actuating device. This is realized by acting counter to the elastic force of the second compression spring 15, and causes the second closing element 14 to be removed from the corresponding valve seat. Thus, a free flow from the supply line to the nozzles in the lower nozzle body 10 and in the upper nozzle body 11 is enabled.

Figure 5:
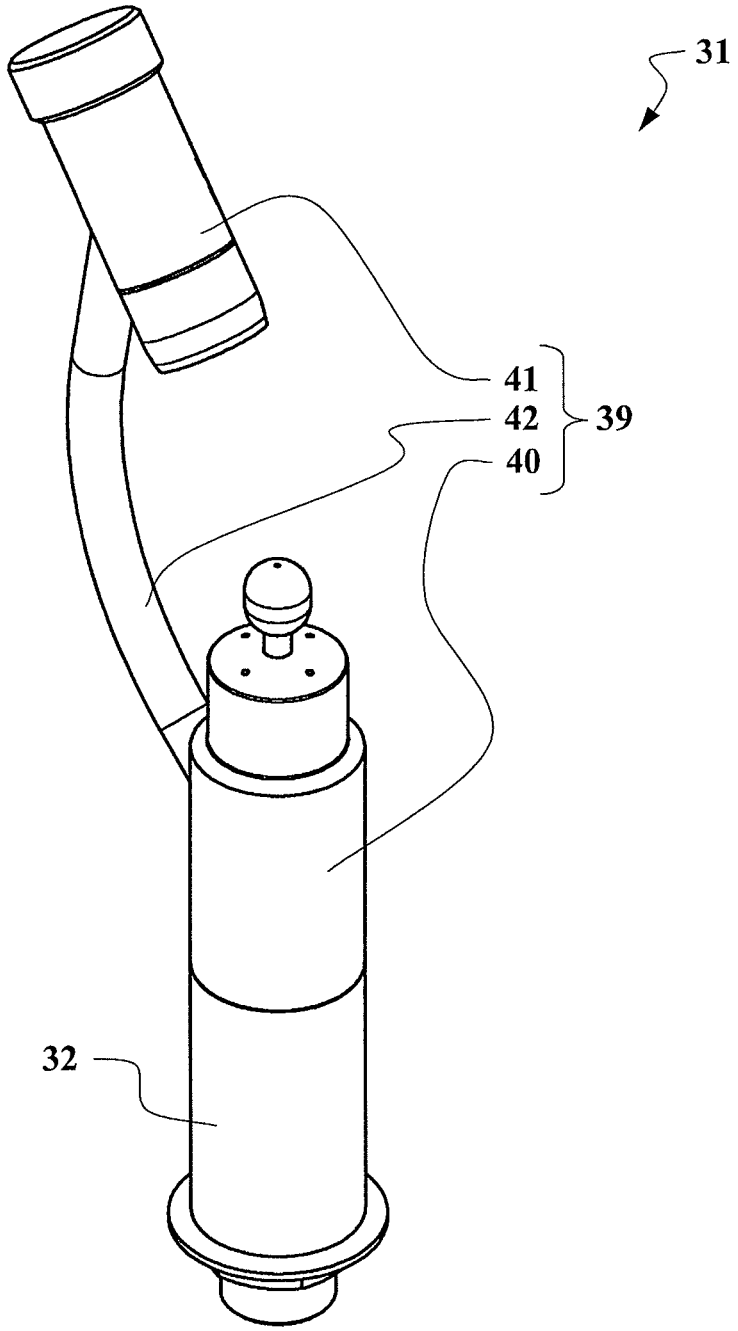
FIG. 5 shows a perspective view of a second embodiment of a cleaning device according to the invention.

FIG. 5 exemplarily illustrates a second embodiment to the solution of a cleaning device. Here, the cleaning device 31 firstly appears to be of the same type as that of the first exemplary alternative. This embodiment of the cleaning device 31 schematically illustrates an option for realizing an inventive embodiment in a second alternative.

Figure 6:
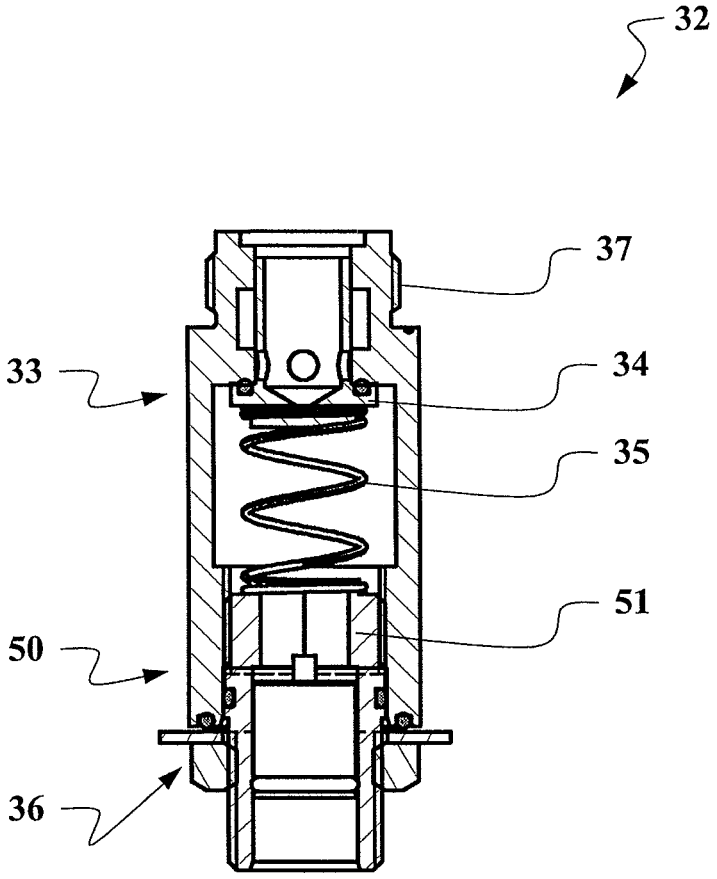
FIG. 6 shows a cross-sectional view of the carrier module of the embodiment according to FIG. 5.

In FIG. 6 the difference in the carrier module 32 is firstly discernible. Here, the closing element 34 having the attached sleeve for actuation is designed with shorter dimensions compared to the exemplary embodiment according to FIG. 2. Thus, it is not possible here to open the actuating valve 33, respectively the closing valve, by depressing the closing element 34 from an upper side by mounting the cleaning module 39.

Figure 7:
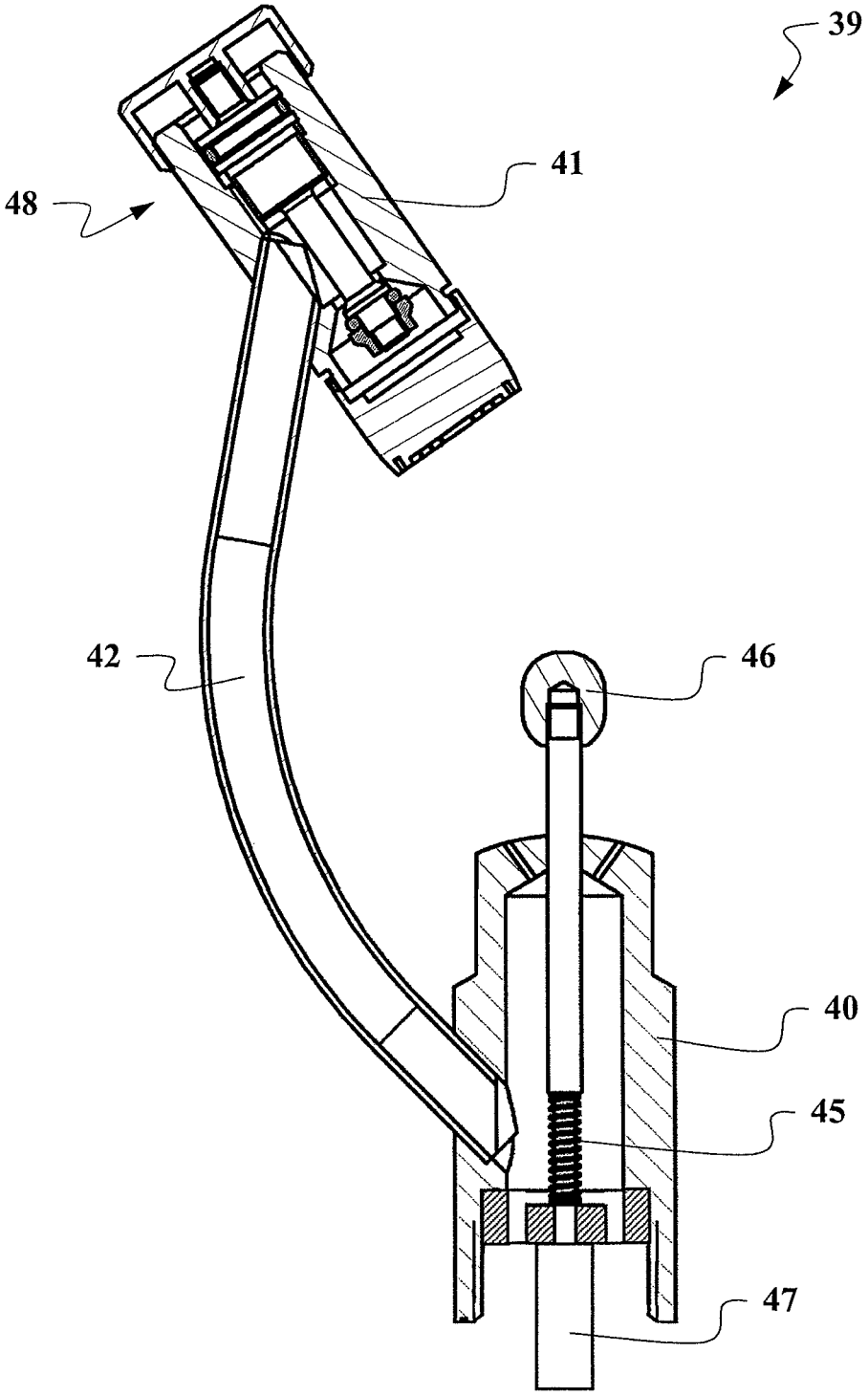
FIG. 7 shows a cross-sectional view of the cleaning module of the embodiment according to FIG. 5.

Instead, in this case, a cleaning module 39 like the one which is exemplarily illustrated in FIG. 7 is necessary. In contrast to the embodiment of FIG. 3, the valve used in the first alternative is completely dispensed with. By contrast, the compression rod 47 of the actuating mechanism is designed so as to be prolonged downwardly. Just like in the first alternative, the compression rod 47 having the compression body 46 is held in the initial position with the aid of the second compression spring 45.

Figure 8:
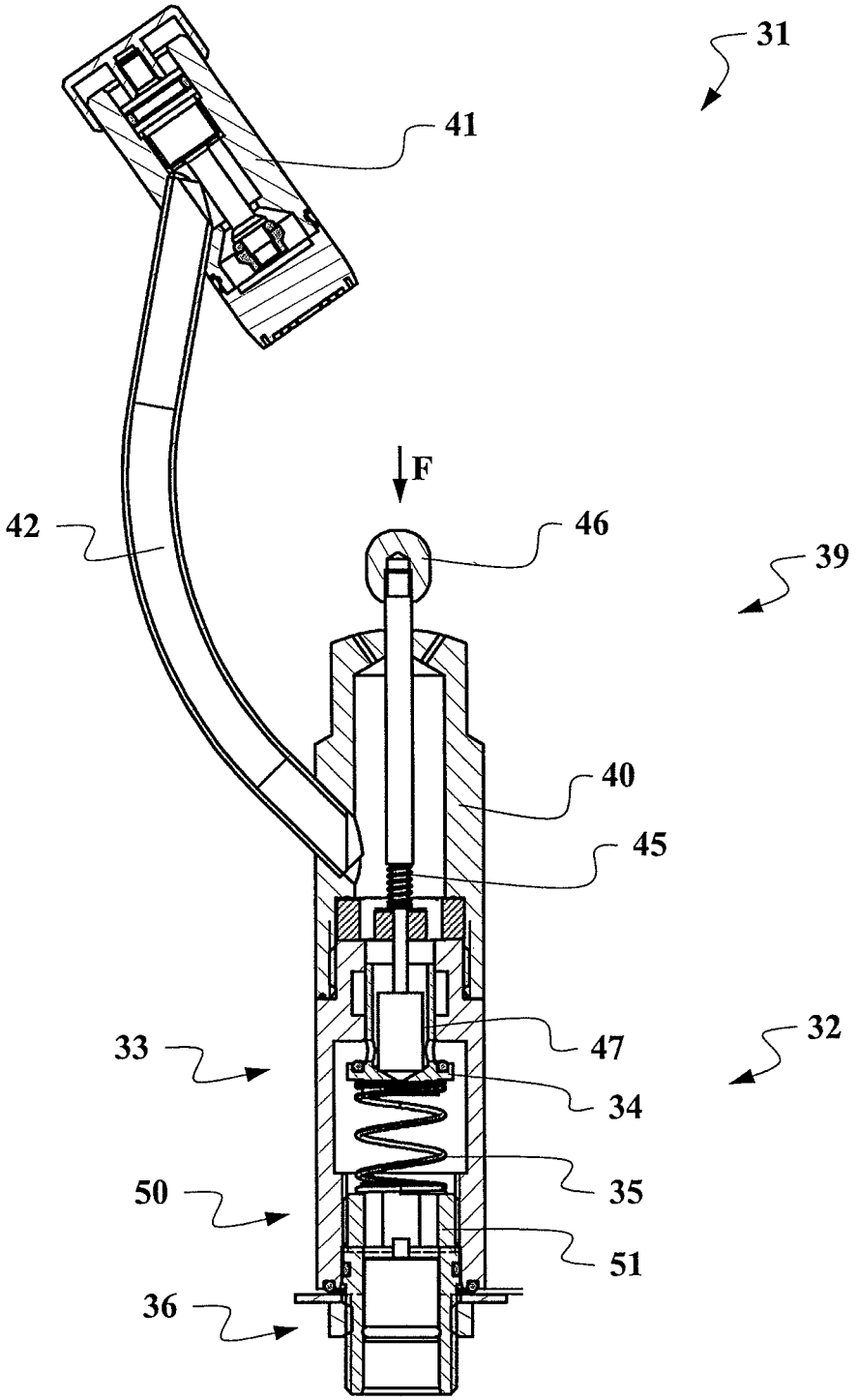
FIG. 8 shows a cross-sectional view of the embodiment of FIG. 5 with the actuating device being in the actuated position.

FIG. 8 in turn shows the cleaning device 31 in a cross-sectional view in the actuated position. Here, in contrast to the first alternative embodiment, it is apparent that the actuating valve 33 simultaneously acts as a closing valve. The prolonged compression rod 47 here causes the closing element 34 to be depressed. Thus, by depression of the compression body 46 upon actuation, the closing valve 33 is opened. Hence, it is apparent that said closing valve, respectively the actuating valve 33, is closed both in the absence of actuation of the actuating device and upon removal of the cleaning module 39.

Figure 9:
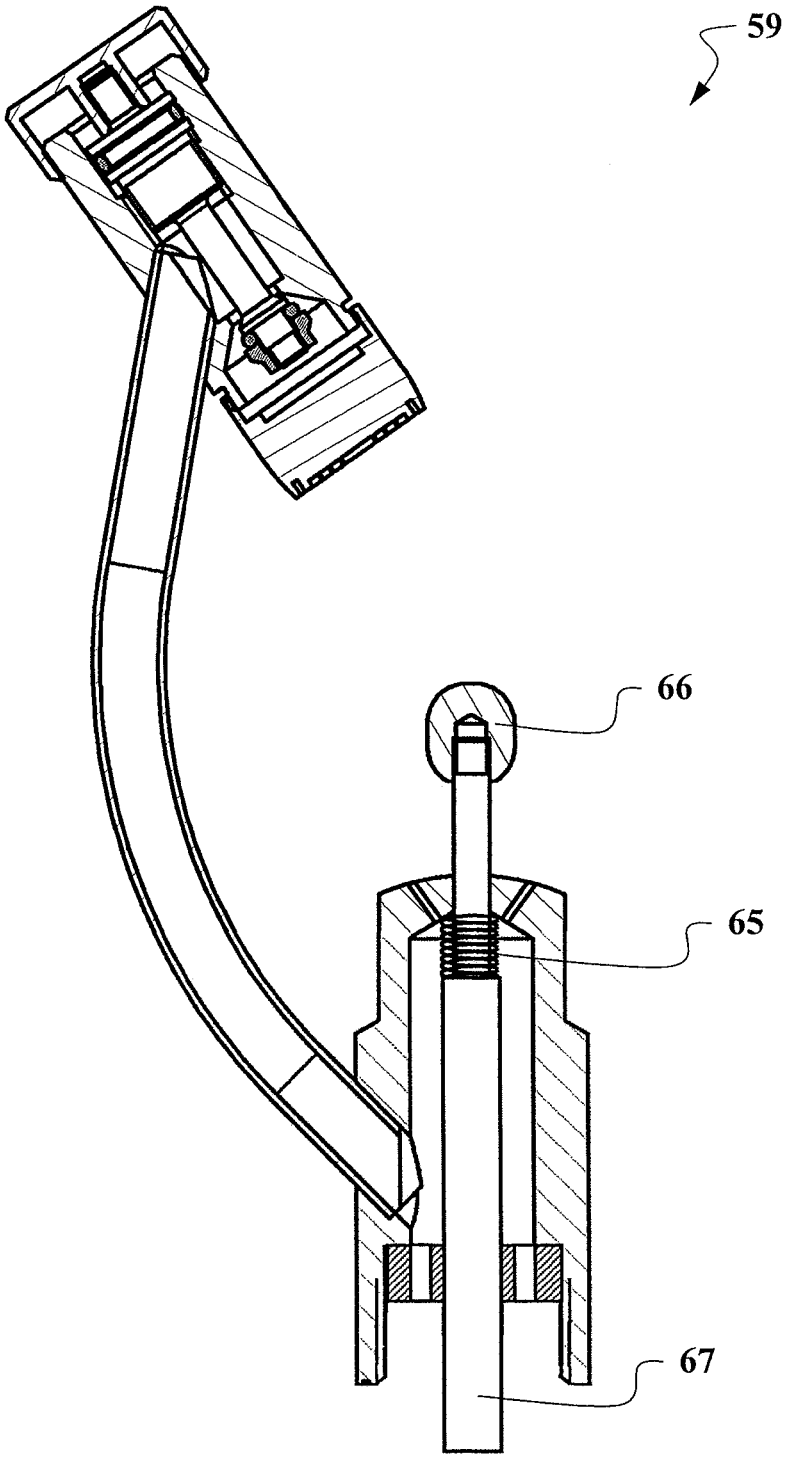
FIG. 9 shows a cross-sectional view of a third embodiment of a cleaning module according to the invention.

FIG. 9 shows a cross-sectional view of a third embodiment of a cleaning module 59 as an alternative to the embodiment according to FIG. 7. This embodiment can be employed for a carrier module 32 being designed in the same manner as illustrated in FIG. 5. In contrast, in this case, the second compression spring 65 is disposed so that it presses the compression rod 67 together with the compression body 66 downwards, i.e. into the direction of the carrier module. It is apparent that upon removal of the cleaning module 59 from the carrier module 32, the compression rod 67 may have a free play, i.e. is longitudinally movable in a loose fashion. The compression rod 67 comes into abutment against the closing element 34 in the carrier module 32 only when the cleaning module 59 is mounted at the carrier module 32, and defines the initial position.

The invention claimed is:

1. Cleaning device for a portioning utensil for portioning ice cream wherein the cleaning device can be inserted into a receptacle and comprises a carrier module which can be mounted in an opening in the receptacle and which can be supplied with a cleaning fluid, and the cleaning device comprises a cleaning module which is releaseably coupled to the carrier module, wherein the cleaning fluid can be dispensed via at least one nozzle of the cleaning module, and the cleaning device comprises an actuating device being disposed in the cleaning module, and the cleaning device comprises an actuating valve being disposed in the carrier module or the cleaning module, wherein upon actuation of the actuating device, a flow of the cleaning fluid is enabled by the actuating valve which is closed in the initial position, wherein a closing valve being disposed in the carrier module, the closing valve features a first movable closing element which is pushed into the direction of the cleaning module onto a first valve seat in the carrier module with the aid of a first compression spring wherein at least upon removal of the cleaning module from the carrier module, the closing valve is closed and a flow is prevented wherein mounting the cleaning element on the carrier module causes the first closing element to be depressed and the closing valve to be opened.

2. Cleaning device according to claim 1 wherein, the actuating device features a compression body which is firmly connected to a second closing element via a compression rod, wherein the compression rod is directly or indirectly pushed into the direction of the compression body with the aid of a second compression spring and enables the initial position, wherein the second closing element abuts against a second valve seat in the cleaning module.

3. Cleaning device according to claim 1, wherein the cleaning module is coupled to the carrier module via a screw thread.

4. Cleaning device according to claim 1, wherein a non-return valve is disposed in the carrier module, wherein an increased pressure prevailing in the supplied cleaning fluid causes the non-return valve to be opened.

5. Cleaning device according to claim 4, wherein the first compression spring simultaneously pushes a third closing element of the non-return valve against a third valve seat in the carrier module.

6. Cleaning device according to claim 1, wherein the cleaning module features a lower nozzle body having a plurality of lower nozzles surrounding a compression rod, and features at least one upper nozzle body having at least one upper nozzle, and features a connecting pipe for coupling the nozzle bodies.

7. Cleaning device according to claim 6, further comprising a variably settable flow restrictor being disposed in the upper nozzle body.

* * * * *